US009247805B1

(12) United States Patent
Malm

(10) Patent No.: US 9,247,805 B1
(45) Date of Patent: Feb. 2, 2016

(54) HAIRBRUSH WITH LIQUID DISPENSING APPARATUS

(75) Inventor: Chad Malm, N. Seminole, FL (US)

(73) Assignee: SOLUTIONWORKS LLC, Seminole, FL (US)

( * ) Notice: Subject to any disclaimer, the term of this patent is extended or adjusted under 35 U.S.C. 154(b) by 486 days.

(21) Appl. No.: 13/608,527

(22) Filed: Sep. 10, 2012

Related U.S. Application Data

(60) Provisional application No. 61/532,906, filed on Sep. 9, 2011.

(51) Int. Cl.
*A46B 11/00* (2006.01)
*B05C 17/005* (2006.01)

(52) U.S. Cl.
CPC ..... *A46B 11/0072* (2013.01); *A46B 11/002* (2013.01); *A45D 2200/056* (2013.01); *B05C 17/005* (2013.01)

(58) Field of Classification Search
CPC combination set(s) only.
See application file for complete search history.

(56) References Cited

U.S. PATENT DOCUMENTS

| | | | | |
|---|---|---|---|---|
| 880,785 | A | 3/1908 | Fields | |
| 1,044,996 | A * | 11/1912 | Cuthbertson | 401/178 |
| 1,339,745 | A | 5/1920 | Dunaway | |
| 1,891,471 | A | 12/1932 | Fotza | |
| 2,235,637 | A | 3/1941 | Hickey | |
| 2,299,296 | A | 10/1942 | Battle | |
| 2,565,889 | A | 8/1951 | Schroer | |
| 2,617,431 | A | 11/1952 | Gaspari | |
| 2,998,822 | A | 9/1961 | Birch et al. | |
| RE25,585 | E | 5/1964 | Birch et al. | |
| 3,184,781 | A | 5/1965 | Hoxie | |
| 3,363,968 | A | 1/1968 | Williams | |
| 3,544,226 | A | 12/1970 | Kellis | |
| 3,612,706 | A | 10/1971 | Verga | |
| 3,653,090 | A | 4/1972 | Weaver | |
| 3,856,027 | A | 12/1974 | Legere | |
| 3,868,188 | A | 2/1975 | Velardi | |
| 3,960,160 | A | 6/1976 | Hogan | |
| 3,961,635 | A | 6/1976 | Miya | |
| 3,973,853 | A | 8/1976 | Myers | |
| 4,013,369 | A | 3/1977 | Turek | |
| 4,055,195 | A | 10/1977 | Moses | |
| 4,252,455 | A | 2/1981 | De La Pena | |
| 4,254,738 | A | 3/1981 | Stanley | |
| D279,648 | S | 7/1985 | Fini | |
| 4,557,619 | A | 12/1985 | DeVincentis | |
| 4,585,018 | A | 4/1986 | O'Connor | |
| D294,406 | S | 2/1988 | Shyh | |
| 4,779,572 | A | 10/1988 | Freulon | |
| 4,893,957 | A | 1/1990 | Byriel | |
| 4,938,621 | A | 7/1990 | Pyrozyk | |
| 4,966,175 | A | 10/1990 | Kimura et al. | |
| 5,000,199 | A | 3/1991 | Kuranski et al. | |
| 5,024,243 | A | 6/1991 | Snyder | |
| 5,393,153 | A * | 2/1995 | Bouthillier et al. | 401/146 |
| 5,746,531 | A | 5/1998 | Izhak | |

(Continued)

*Primary Examiner* — David Walczak
(74) *Attorney, Agent, or Firm* — Abelman, Frayne & Schwab

(57) ABSTRACT

A spray brush includes at least one fluid-dispensing outlet which is positioned on a manifold and is, through the manifold, in fluid communication with a pump assembly, which is in fluid communication with a fluid reservoir. The manifold is contained in a brush head. A pump trigger is in mechanical cooperation with the manifold, and circumferentially surrounds a portion of a brush handle. Activation of the pump trigger is accomplished by depressing or pulling from any normal hand-held position without the need for additional rotation of the hairbrush.

18 Claims, 8 Drawing Sheets

(56) References Cited

U.S. PATENT DOCUMENTS

| | | | |
|---|---|---|---|
| 5,909,737 | A | 6/1999 | Ricco |
| 5,927,290 | A | 7/1999 | Thiruppathi |
| 6,024,101 | A | 2/2000 | Garner |
| 6,035,806 | A | 3/2000 | Lorenzo |
| 6,213,129 | B1 | 4/2001 | Muldoon |
| D445,969 | S | 7/2001 | Lorenzo |
| 6,257,246 | B1 | 7/2001 | Kan |
| 6,276,367 | B1 | 8/2001 | Piatetsky |
| 6,325,070 | B1 | 12/2001 | Tyroler et al. |
| 6,530,378 | B1 | 3/2003 | Piatetsky |
| 6,631,724 | B2 | 10/2003 | Mugge et al. |
| 6,672,313 | B2 | 1/2004 | Battaglia et al. |
| 6,745,779 | B2 | 6/2004 | Piatetsky |
| 7,011,468 | B1 | 3/2006 | Leventhal |
| 7,063,090 | B2 | 6/2006 | Wang et al. |
| 7,182,043 | B1 | 2/2007 | Nelson |
| 7,237,277 | B1 | 7/2007 | Tsai et al. |
| 7,261,108 | B2 | 8/2007 | Dallianis et al. |
| D572,417 | S | 7/2008 | McKay |
| 2002/0153020 | A1 | 10/2002 | Fiore |
| 2004/0031499 | A1 | 2/2004 | Stankovic et al. |
| 2004/0261808 | A1 | 12/2004 | Kluge |

* cited by examiner

HAIRBRUSH WITH LIQUID DISPENSING APPARATUS

RELATED APPLICATIONS

This application claims the benefit of U.S. Provisional Patent Application No. 61/532,906 filed Sep. 8, 2011, the disclosure of which is hereby incorporated by reference in its entirety.

BACKGROUND OF THE INVENTION

1. Field of the Invention

This invention relates to hairbrushes, and in particular to hairbrushes incorporating a liquid dispensing assembly.

2. Description of Related Art

A common problem encountered by hairdressers and individuals occurs during the acts of styling or curling hair with a hairbrush with one hand, and then picking up a bottle of hair spray or setting fluid and spraying the hair that is curled or otherwise styled with the brush with the other hand. The individual or stylist also typically sets down the bottle to manipulate a hairdryer so that the fluid can be dried while the hair is in the curled or styled position. This is a tedious but conventional method typically repeated dozens of times by each stylist hundreds of times per month, and can lead to repetitive motion injuries or conditions.

There exist various types of hairbrushes with integrated spray structures. However, a common problem among those that exist relates to the ease of manipulation of the mechanism that actuates the spray. For instance, RE25585, US D279648 and U.S. Pat. No. 1,891,471 show mechanisms at the back of the handle. U.S. Pat. No. 5,746,531 describes a brush in which the spray emits from the opposite end. U.S. Pat. No. 7,011,468, U.S. Pat. No. 5,927,290 and U.S. Pat. No. 4,055,195 disclose pressurized reservoirs. U.S. Pat. No. 5,909,737 discloses an electric pump. US 2004/0031499A1 discloses fluid that is discharged via gravitational force. U.S. Pat. No. 5,024,243, U.S. Pat. No. 7,261,108 and U.S. Pat. No. 2,617,431 disclose brushes in which the handle must be squeezed in order to spray fluid.

Certain brush configurations have a trigger mechanism proximate the intersection of the handle and the brush head. For instance, U.S. Pat. No. 4,557,619 discloses an aerosol can in which a wire element couples to a trigger of the spray can. In addition, the trigger is in a compromising position. With the relation to the brush head bristles and the spray trigger it is inevitable hair would become entangled in the trigger when in use for curling and other styling operations.

U.S. Pat. No. 2,235,637 discloses a pair of studs to manipulate a piston. Liquid travels through a number of narrow chambers leaving the pump system difficult to clean and maintain.

US 2002/0153020A1 discloses an actuator on a spray bottle at the intersection of the handle and the brush head. The liquid sprays through bristle chambers, and uses a brush handle/aerosol can that is disposable. Aerosol cans have a wide grip making it difficult to manipulate around the head.

U.S. Pat. No. 1,339,745 discloses a trigger for moving a valve plate that regulates liquid dispensation. This design is intended for low viscosity fluids, and it is difficult to control the amount of fluid being sprayed.

Therefore, a need exists for a brush with a dispensing apparatus that is easy to manipulate, convenient to clean and refill, and conducive to dispensing fluid during the styling process thus alleviating the labor involved by stylists and individuals.

SUMMARY

In accordance with one or more embodiments, a spray brush is provided including at least one fluid-dispensing outlet which is positioned on a manifold and is, through the manifold, in fluid communication with a pump assembly, which is in fluid communication with a fluid reservoir. The manifold is contained in a brush head. A pump trigger is in mechanical cooperation with the manifold, and circumferentially surrounds a portion of a brush handle. Activation of the pump trigger is accomplished by depressing or pulling from any normal hand-held position without the need for additional rotation of the hairbrush.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWING

The foregoing summary as well as the following detailed description will be best understood when read in conjunction with the attached drawings. There are shown in the drawings embodiments which are presently preferred. It should be understood, however, that the scope of the claims is not limited to the precise arrangements and apparatus shown. In the drawings, similar reference numerals are used to refer to the same or similar elements in different embodiments, in which:

DETAILED DESCRIPTION OF THE INVENTION

The spray brush described herein including a fluid-dispensing apparatus is the solution to the problem for hairdressers that need to expedite the conventional process of styling or curling hair with a hairbrush in one hand while the other hand picks up a bottle of hair spray or setting fluid to spray the hair that is styled or curled around the brush only to set down the hair spray so they can pick up a hairdryer so the hair spray can be dried while the hair is in the styled or curled position. This is a tedious but conventional method repeated dozens of times on millions of people in salons throughout the world.

The spray brush described herein eliminates the need to set down the hairspray bottle to exchange it for a hairdryer because the hairspray container, dispenser pump, and nozzles are built into the brush itself.

An important drawback of conventional brushes with an integrated dispensing apparatus is the lack of integration of the spray pump trigger into the brush in a manner that permits activation from any hand position around the brush handle, in particular when the brush is rotated to "pick up" the hair. Since it is impossible to predetermine how many turns of the brush will be needed to style or curl the hair in the desired area of the hair such as near the scalp or near the ends of the hair, it would be impractical to have a conventional spray trigger on one side. Such a configuration would complicate the tasks of rotating the brush to curl the hair, maintaining the brush and the hair steady in the desired position, and simultaneously activating a conventional pump trigger that could end up on any side of the brush.

Figure 1:
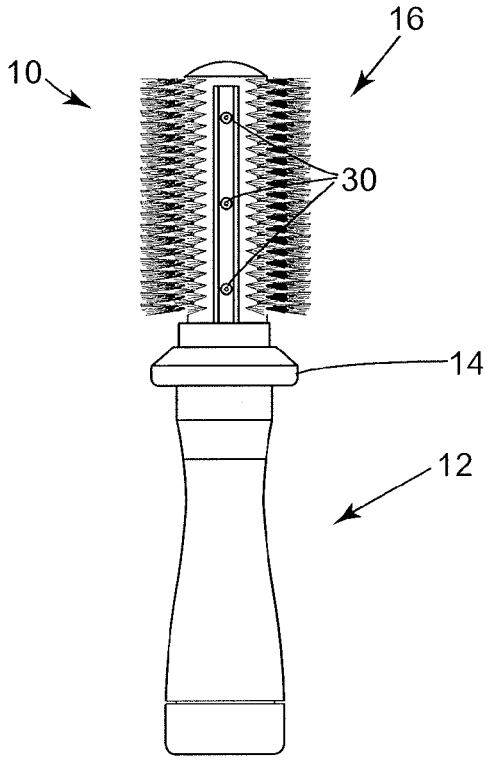
FIG. 1 is an isometric view of one embodiment of a spray brush.
Figure 2:
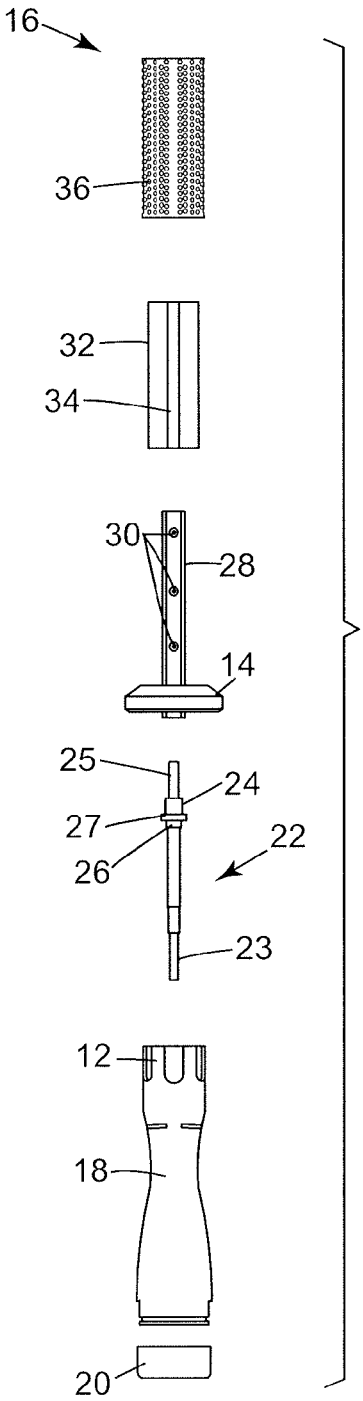
FIG. 2 is an exploded view showing the assembly of parts that form the spray brush shown in FIG. 1.
Figure 3:
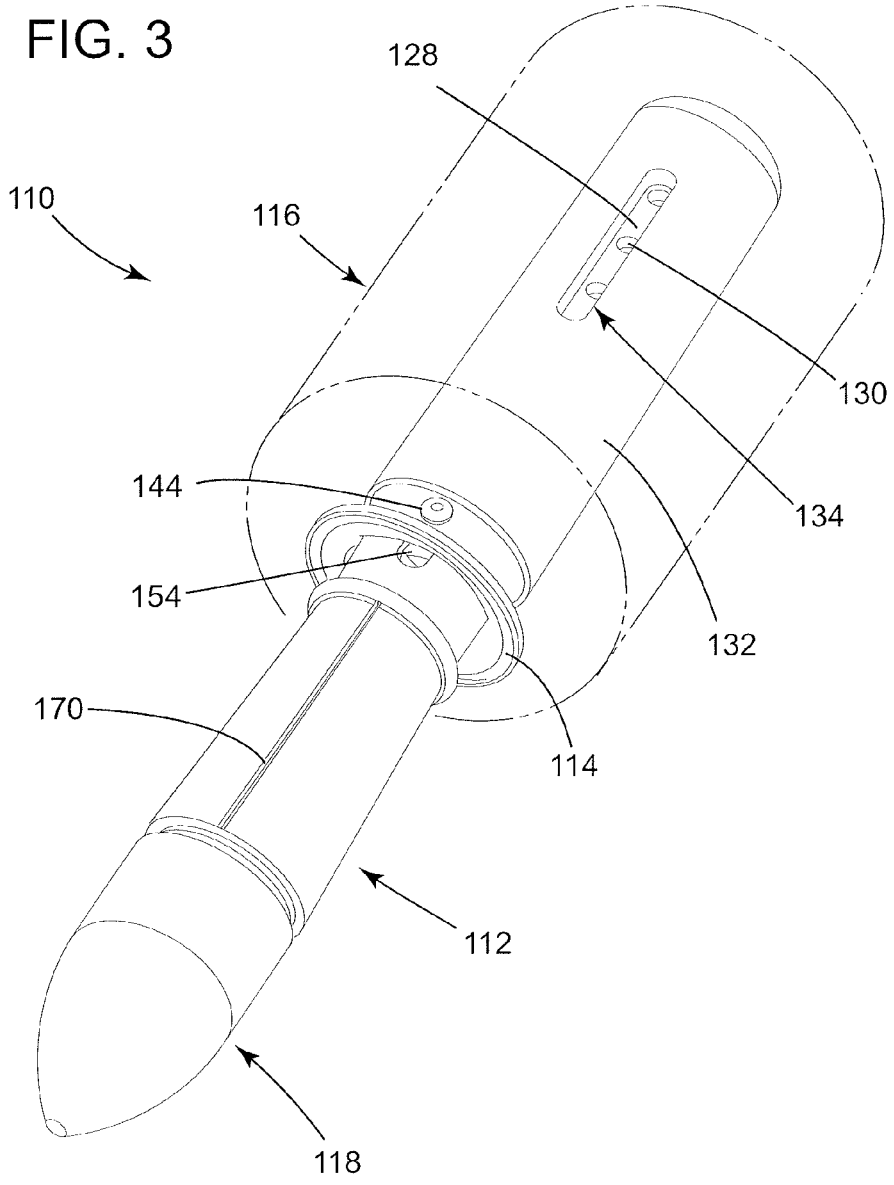
FIG. 3 is an isometric view of another embodiment of a spray brush.
Figure 4:
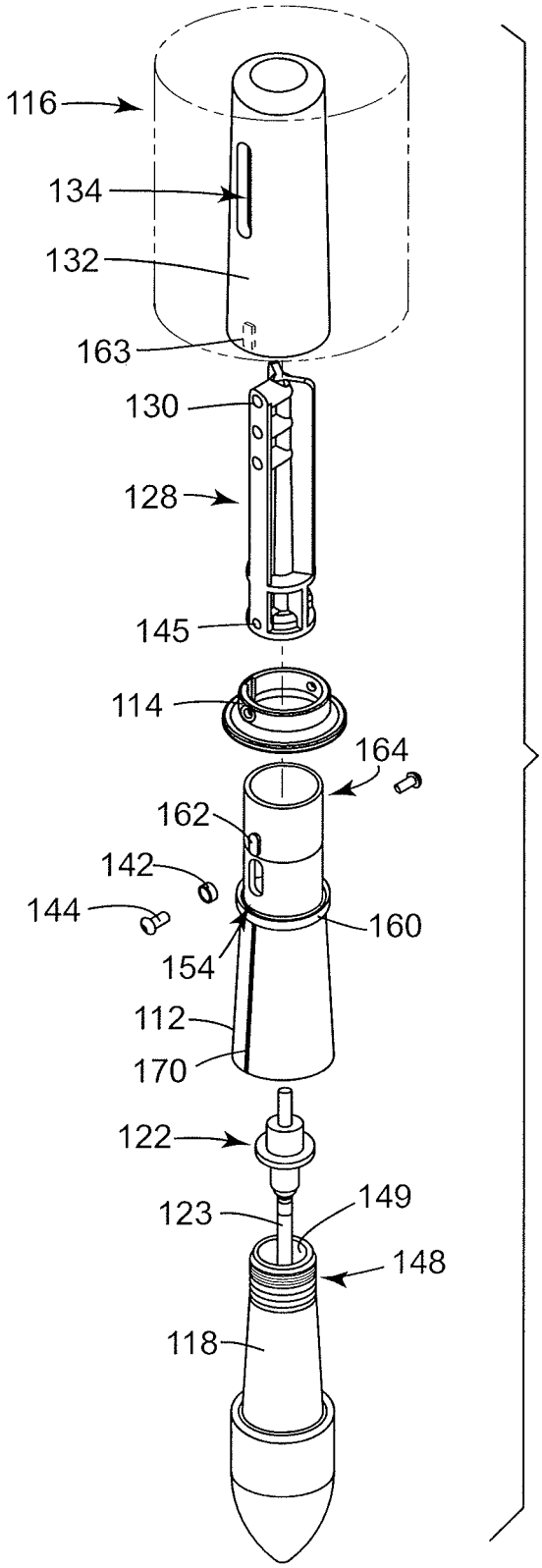
FIG. 4 is an exploded view showing the assembly of parts that form the spray brush shown in FIG. 3.
Figure 5:
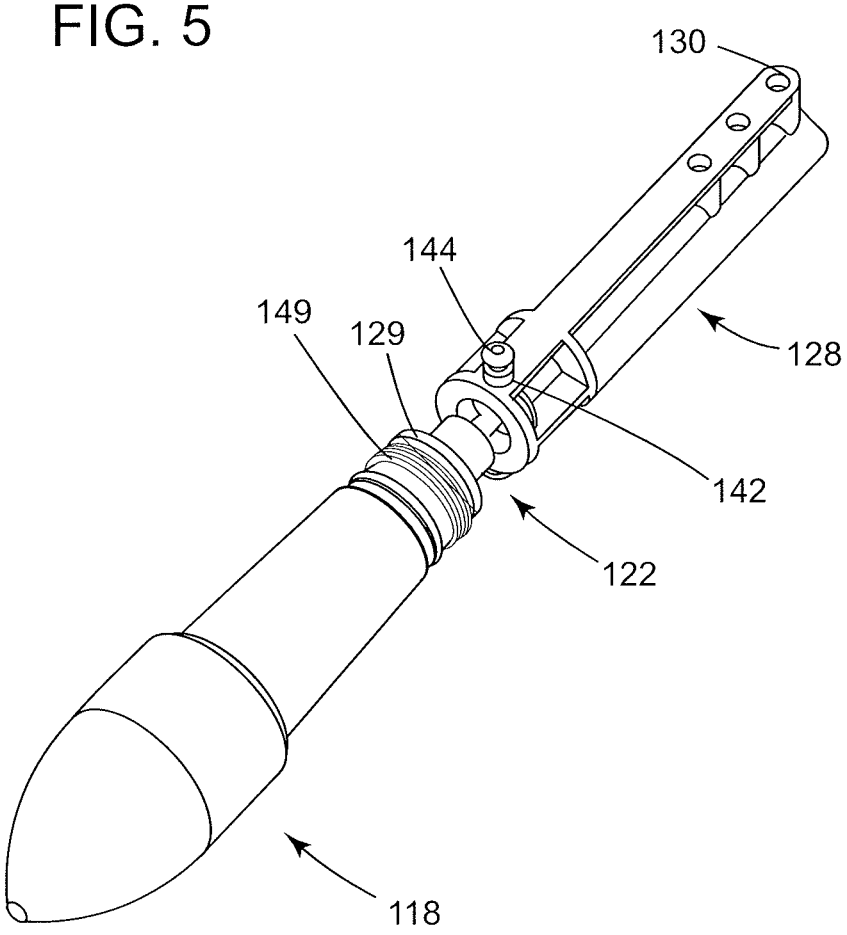
FIG. 5 is a view of a reservoir and manifold used in the spray brush shown in FIG. 3.
Figure 6:
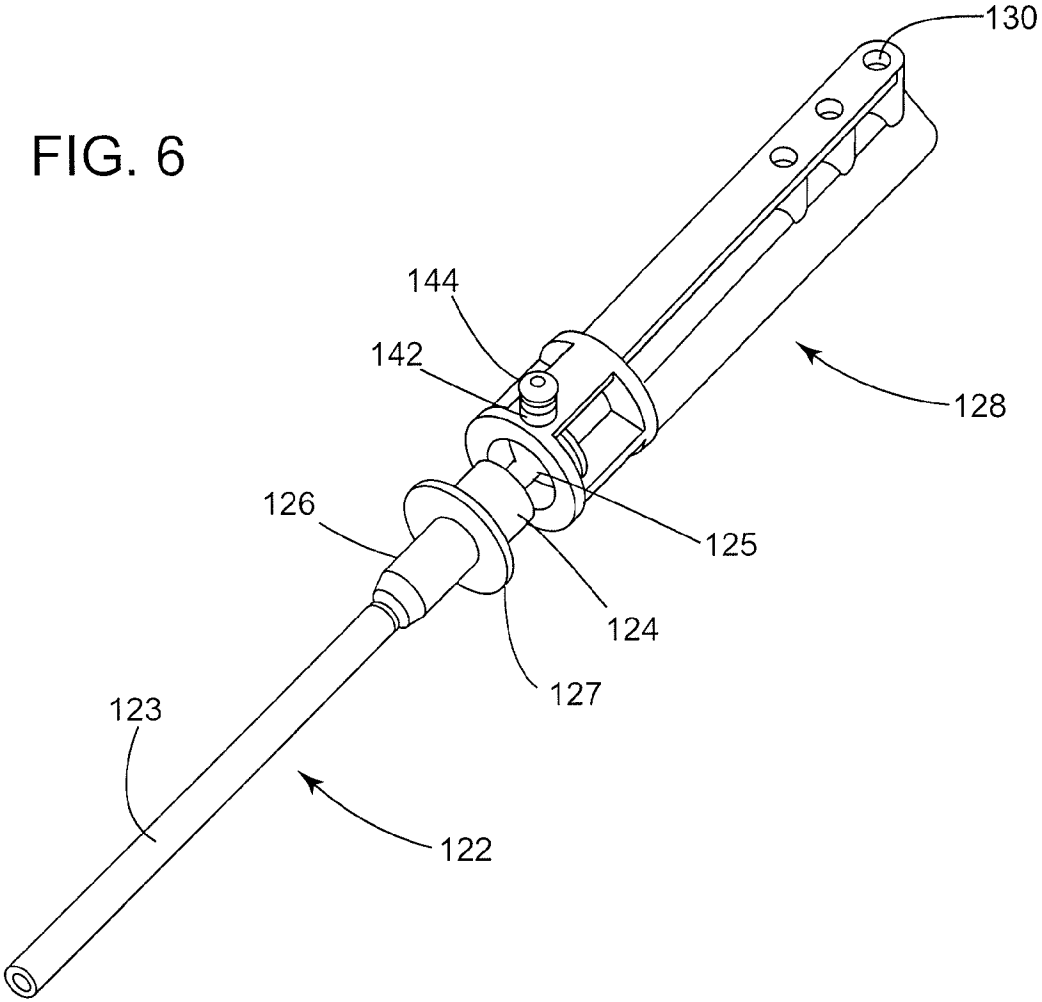
FIG. 6 is a view of a pump assembly and manifold used in the spray brush shown in FIG. 3.

Accordingly, and with reference to FIGS. 1-2, a generalized view of a spray brush 10, i.e., including a dispensing apparatus, is provided. Note that in FIGS. 1-2, seals and various internal spacers are not shown.

In general, the brush 10 includes a handle/reservoir portion 12, a spray trigger 14 and a brush head 16. The handle/reservoir portion 12 includes a liquid reservoir 18 for containing a desired hair care liquid or water, a cap 20, e.g., that is opposite the trigger and brush head and that can be threadably engaged with an end of the liquid reservoir 18. In certain embodiments, for instance as shown herein with respect to FIGS. 3-9, a removable reservoir can be provided, whereby a cap is not required.

Spray trigger 14 is in mechanical cooperation with a manifold 28, which in turn is in mechanical and fluid communication with a portion of a pump assembly 22. In certain embodiments, spray trigger 14 and manifold 28 can be formed as an integral unit.

Pump assembly 22 can be, for instance, a simple reciprocating pump assembly including a displaceable hollow piston 25, a cylinder 26 containing a spring therein (not shown), the spring being mechanically coupled to a hollow displaceable piston 25, a stationary portion 24, a pump deck portion 27 and a drawtube 23 that extends into the reservoir 18 and is in fluid communication with piston 25 via cylinder 26. In certain embodiments, the pump assembly 22 can include a one-way intake valve, e.g., in or proximate to cylinder 26 with a spring or similar structure, to facilitate spraying in any orientation of the brush. The drawn liquid is forcibly discharged generally into manifold 28 and exits the brush head 16 via plural outlets 30.

In one embodiment, pump assembly 22 is operated by depressing the trigger 14, which is in mechanical cooperation with manifold 28, which envelops and drives piston 25. Piston 25 is pushed into stationary portion 24 and cylinder 26 thereby compressing the spring, so that when trigger 14 is released, piston 25 is pushed back out of cylinder 26 and stationary portion 24. Fluid from the reservoir is drawn through drawtube 23 and through hollow piston 25 and into manifold 28 for dispensing through outlets 30. The pump assembly 22 is held in place, for instance, by suitable features in handle 12 such as one or more shelves.

Brush head 16 includes a bristle base core 32 having a gap 34 or equivalent aperture(s) to accommodate discharge of fluids from the spray manifold 28. A bristle base surface 36 is tightly fit over the bristle base core 32 and includes a suitable gap or apertures permitting passage of fluid from outlets 30. Bristles are not shown in FIG. 2; it will be appreciated that various types of bristles could be used on the brush heads of the embodiments herein in an arrangement to accommodate emission of the fluid to be dispensed. In certain embodiments bristle base core 32 generally has a C-shaped cross-section to provide gap 34.

In operation, a user depresses trigger 14, which can be a ring or other suitable shape that is provided at the intersection of the brush head 16 and the handle/reservoir portion 12. Trigger 14 circumferentially surrounds the handle/reservoir 12. Trigger 14, when pressed or pulled towards the handle with one's fingers or thumb from any position after rotation of the brush 10, displaces manifold 28 which depresses the piston 25 of pump assembly 22 to draw liquid from the liquid reservoir 18 as described herein. The spray trigger 14 is accessible at all rotations of the brush and is located at the upper portion of the handle/reservoir 12. Because of its easy access, the thumb and/or the pointer finger can be used to manipulate trigger 14. The manipulation and rotation of the unit as the whole is typically accomplished by using one's thumb to roll the handle/reservoir 12 along the middle finger and ring finger while the pointer finger is pointed up and away, ready to act on trigger 14. In certain embodiments, the spray trigger 14 has a partial dome or hat shape with the wider portion toward the handle and the narrower portion toward the bristles. A user can both dispense liquid and manipulate brush 10 in the conventional manner, e.g., slightly pull the round brush up the hair shaft and then roll it back down, which serves to distribute the liquid. Advantageously, this can be accomplished with a single hand, for instance, when the user has a blow dryer in their other hand. This saves time and effort for a stylist or individual styling their own hair.

The spray outlets 30 are aligned so that they are exposed through the apertures or gap 34 of brush head core 32. Brush head core 32 locks into the top of the handle 12 above the trigger 14 to prevent slippage. A portion of pump assembly 22 (e.g., disc-shaped pump deck 27) rests on an internal shelf (not shown) while the drawtube 23 extends into the reservoir 18 to draw liquid contents thereof, and the hollow piston 25 extends into an intake region of manifold 28. Suitable nozzles to be used at outlets 30 can include atomizers, for instance, similar to those currently used in conventional misting sprayers.

In certain embodiments, the assembly easily pulls apart and snaps or otherwise fits together for ease of cleaning. In addition, the ease of breaking down the brush makes packing and product packaging convenient, along with providing the ability to interchange, repair and/or replace certain parts, such as one or more of the manifold, brush-head, reservoir, bristles and/or pump assembly.

Referring to FIGS. 3-9, another embodiment of a spray brush including a liquid dispensing assembly is shown. Spray brush 110 generally includes a brush head 116 including a brush head core 132 and bristles (shown only as an outline view). Brush head core 132 includes a manifold 128 slidably positioned therein, which includes outlets 130 that are exposed via an aperture 134. A manifold channel 152 within manifold 128 is in fluid communication with a fluid reservoir 118 attached to a handle core 112 through a pump assembly 122. Fluid is dispensed from outlets 130 which are fluidly connected to manifold channel 152 via canals 153, upon displacement of trigger 114 which is in mechanical cooperation with pump assembly 122, for instance, via trigger spacers 142 and fasteners 144 (e.g., screws or bolts) to manifold 128.

The spray trigger 114 is in mechanical cooperation with manifold 128, which is in turn in mechanical and fluid communication with a portion of a pump assembly 122 by fitting a displaceable portion in an intake of the manifold, which is in fluid communication or integral with channel 152.

Pump assembly 122 can be, for instance, a simple reciprocating pump assembly including a displaceable hollow piston 125, a cylinder 126 containing a spring therein (not shown) which is mechanically coupled to piston 125, an upper stationary portion 124, an integral pump deck 127 and a drawtube 123 that extends into the reservoir 118. The drawn liquid is forcibly discharged into channel 152 of manifold 128 and exits the brush head 116 via plural outlets 130 in fluid communication with channel 152 via canals 153. Outlets 130 can include suitable nozzles to distribute the fluid.

The fluid reservoir 118 shown in this embodiment includes a sloped or rounded cone-shaped end portion which serves to contain fluid relative to drawtube 123 of the pump assembly 122, improving concentration of the fluids into the tip of reservoir 118 and minimizing the amount of fluid that is inaccessible by the drawtube 123. The shaft portion of reservoir 118 generally has a width matching the widest point of the grip portion of core 112, providing a volume of fluid to allow for multiple applications while providing suitable dimensions and weight for comfortable use, storage and transport. The upper portion of reservoir 118 is sloped to accommodate the angle of the grip of core 112. Reservoir 118 includes a threaded portion 148 that mates with a threaded portion 146 in core 112, and a top edge 149 that supports pump assembly 122 via the integral pump deck 127, in certain embodiments also including sealing gaskets between top edge 149 and pump deck 127.

A suitable pump assembly 122 is used that fits entirely within the core 112, reservoir 118 and manifold 128 as described herein. In general, the pump assembly includes a mechanically displaceable portion (including piston 125) and a stationary portion (including cylinder 126, upper stationary portion 124 and pump deck 127). The stationary portion is positioned interior to the brush handle core portion and/or the brush head core portion, in certain embodiments within the brush handle core portion held in place by one or more features extending from an inner wall of the brush handle portion. As described above, the removable fluid reservoir 118 can also support the pump assembly 122 in place. The mechanically displaceable portion of the pump includes a fluid passageway in fluid communication with a manifold fluid channel 152 and mechanically coupled to a portion of the manifold 128. Drawtube 123 can include, for instance, a generally flat tipped inlet. Its length can be determined by the distance to the bottom of reservoir 118.

On the downward action, manifold 128 pushes the mechanically displaceable portion 125 of pump assembly 122. On the return action, the mechanically displaceable portion 125 of pump assembly 122 pushes manifold 128.

As noted above, pump assembly 122 includes a suitable mechanism, such as a spring (not shown) contained within cylinder 126. In the embodiment of FIGS. 3-9, the cylinder 126 having drawtube 123 extending therefrom is positioned under a shelf portion 150 of handle core 112, which contacts pump deck 127 to prevent pump assembly 122 from extending in the direction towards the brush head. As noted above, reservoir 118 holds pump deck 127 in place from the bottom via its top edge 149 and prevents pump assembly 122 from extending in the direction towards reservoir 118. The upper portion of pump assembly 122 including the stationary portion 124 and piston 125 pass through and above the shelf portion 150. The piston 125 extends up from the pump assembly 122 and into the entrance of the manifold channel 152.

In certain embodiments, the pump assembly 122 can include a suitable structure such as a one-way intake valve, e.g., in or proximate to cylinder 126 with a spring or similar structure, to facilitate spraying in any orientation of the brush. For instance, a suitable structure accommodates inverted brush operation, e.g., when the reservoir's fluid is away from the drawtube inlet.

Brush handle core 112 can be of any suitable configuration and dimension to accommodate fluid reservoir 118 and provide a comfortable and/or ergonomic grip for the user, and includes features to permit displacement of trigger 114. For instance, as shown handle core 112 includes a sloped portion of suitable diameter to give users sufficient control. For instance, the diameter of the widest portion of core 112 can be about 1.25 inches to about 1.75 inches, and taper to a diameter of about 1 inch to about 1.25 inches below protrusion 160. Core 112 also includes a threaded portion 146 that mates with threaded portion 148 of the reservoir 118.

Core 112 includes apertures 154 on opposing sides that accommodate fasteners 144 and spacers 142 that connect the trigger 114 to manifold 128. These apertures are suitably configured and dimensioned to permit the trigger to be displaced and thereby cause fluid to be pumped. In certain embodiments, the assembly of trigger 114 and manifold 128 through apertures 154 of handle core 112 are formed so as to be tamper-resistant by the user. In alternative embodiments, this assembly can be formed so that certain parts can be modified by the user, for instance, to replace a damaged manifold or to accommodate a manifold designed to handle fluid of differing viscosities.

Brush handle core 112 includes a circumferential protrusion 160 which serves to enhance the leverage of a user in pulling the trigger 114, as it stops a user's hand from traversing up the handle core 112 as their pointer finger/thumb pull trigger 114 down. Protrusion 160 is also dimensioned and configured so as not to obstruct one's thumb or pointer finger as these digits extend toward trigger 114. In addition, as described above, brush handle core 112 includes internal shelf 150 against and through which pump assembly 122 is braced via contact with pump deck 127.

In certain embodiments the outer portion of handle core 112 includes certain ergonomic features to enhance the comfort of the user. For instance, the outer surface of handle core 112 can be textured to permit gripping with wet hands. In addition, brush handle core 112 can include an alignment ridge 170 (e.g., a raised protrusion) generally along its length that is along substantially the same line as outlets 130, whereby visual and haptic information regarding the position of outlets 130 is conveyed to the user. In addition, alignment ridge 170 can be configured and dimensioned to provide a degree of traction to one's grip, lending to better control and workability.

Figure 8:
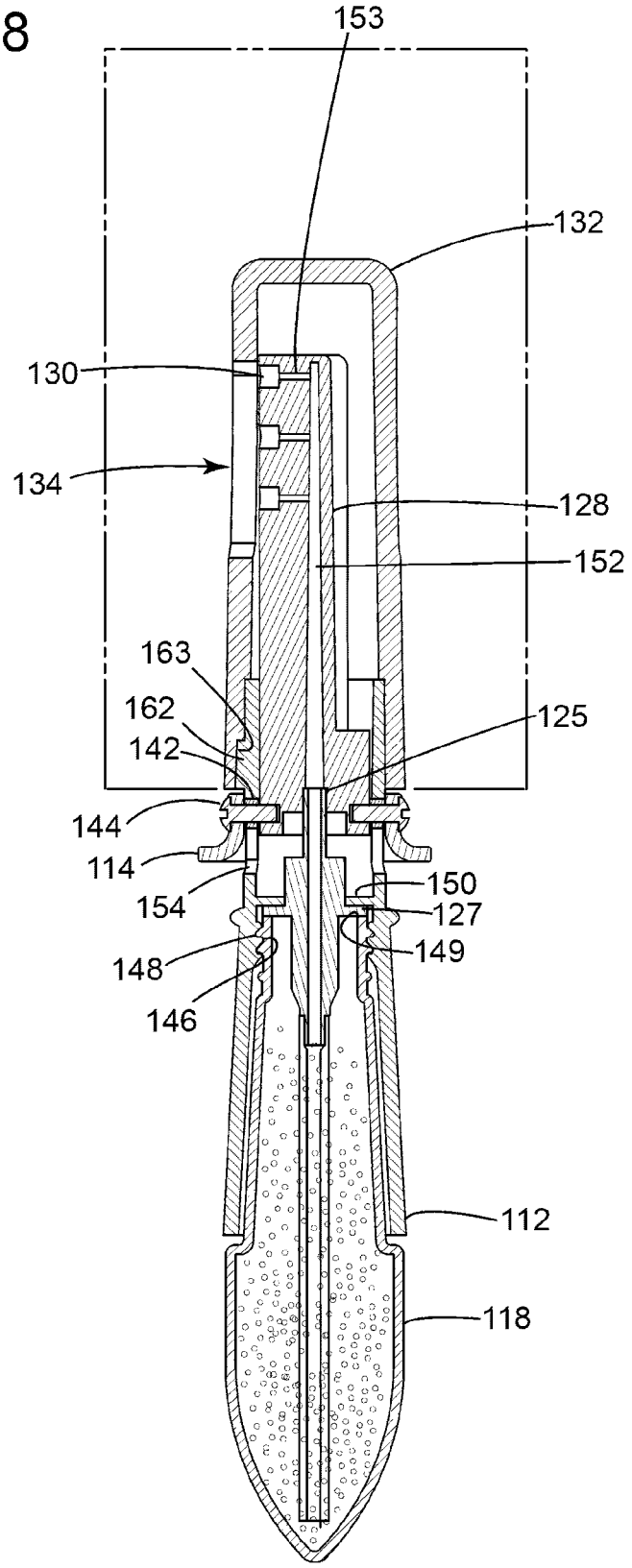
FIG. 8 is a cross-sectional view of the spray brush of FIG. 3 showing fluid in the reservoir.
Figure 9:
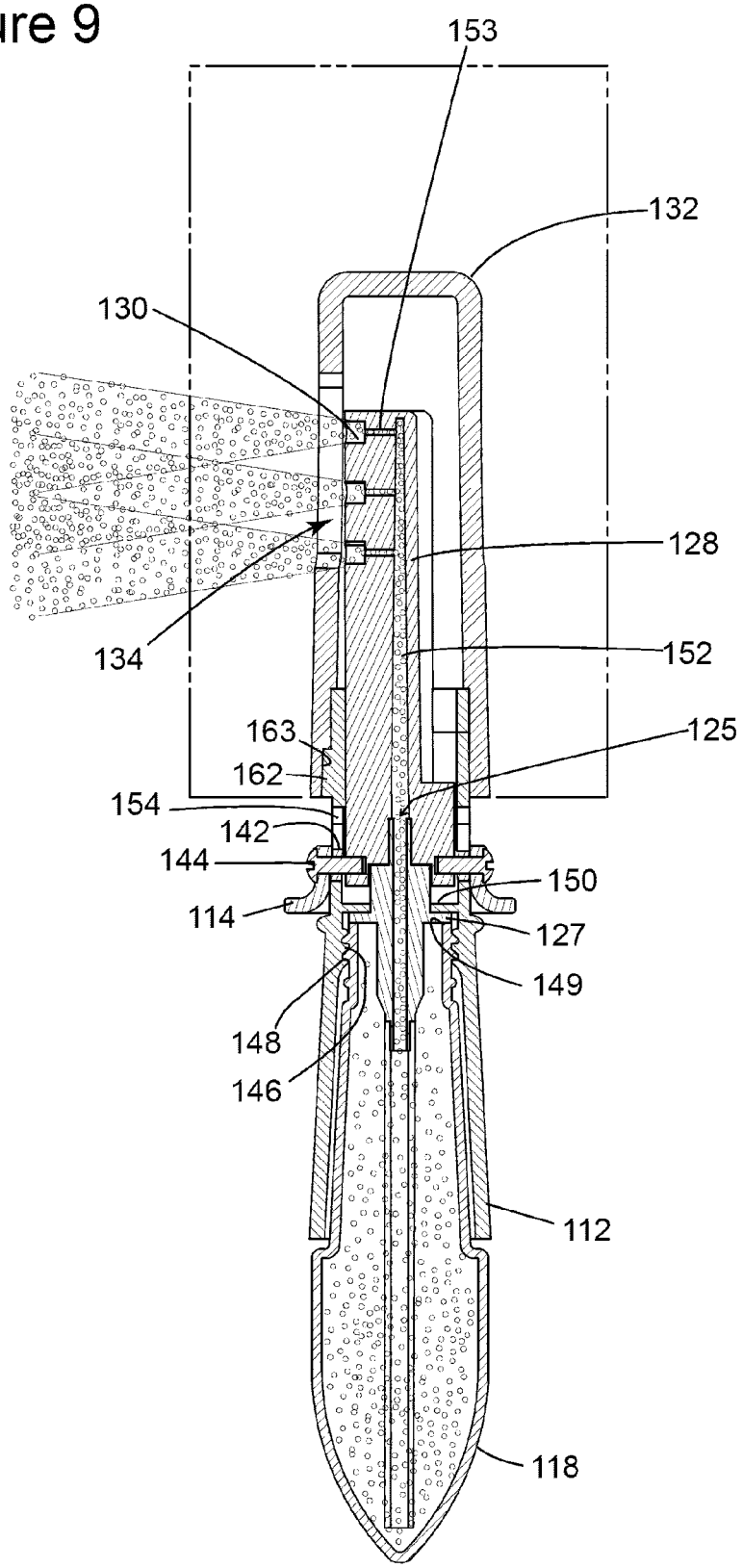
FIG. 9 is a cross-sectional view of the spray brush of FIG. 3 showing fluid throughout the assembly and being emitted from the outlets.

In certain embodiments the upper portion of core 112 can include features that facilitate insertion and removal of a brush head. For instance, a protrusion or tab 162 can be included on handle core 112, which aligns with a mating slot 163 positioned on the interior surface wall of brush head core 132. When tab 162 and slot 163 are engaged, for instance, as shown in FIG. 8, the brush head is prevented from rotation relative to the handle during use. In addition, the engagement of tab 162 and slot 163 also ensures the correct alignment of the brush head 116 with aperture 134 and outlets 130. While the engagement is shown as a protrusion 162 and slot 163, other mechanical locking features can be used.

In addition, the upper portion of core 112 that engages the brush head core 132 can be tapered. In certain embodiments, the entire brush head 116 can be interchangeable and easily removed from handle core 112 without the use of tools, for instance by threaded engagement. Alternative embodiments can include snap fit or twist-off removable engagement. These embodiments provide for easy cleaning of the brush head 116 and also allow a user to replace a worn or damaged brush head and/or select a different brush head.

Manifold 128 is generally open at its bottom inlet end to receive and seal hollow piston 125 of the pump assembly 122 and thereby provide mechanical cooperation with piston 125 and fluid communication with reservoir 118 through the core of piston 125, upper stationary portion 124, cylinder 126 and drawtube 123. A void area is also provided in the embodiment of FIGS. 3-9 to accommodate the upper stationary portion 124 of the pump assembly 122, as it would otherwise block the trigger-spacer-screw-manifold assemblage as it is displaced towards the reservoir. Manifold 128 is configured and dimensioned at its base region in mechanical cooperation with trigger 114 to create suitable depth and stability for fasteners 144 and spacers 142. Manifold fastener receptacles 145 are provided to receive fasteners 144.

Manifold 128 also includes internal channel 152 to direct fluid from the reservoir to the outlets 130 via connecting canals 153. In certain embodiments, channel 152, canals 153, and/or outlets 130 can be configured and dimensioned to compensate for fluid pressure drop along the length of the manifold. In certain embodiments, channel 152 can be tapered to facilitate manufacturing. In certain embodiments manifold 128 can be molded as a single component, e.g., with canals 153 and channel 152 formed by piercing into the soft plastic.

Brush head core 132 can be provided with bristles (not shown), or another component that includes brush bristles can be installed over core 132. In general, the bottom portion of brush head core 132 fits over the upper portion of handle core 112, and can include slot 163 on an internal wall thereof that is aligned with tab 162 protruding from handle core 112. Further, the interior of brush head core 132 is configured and dimensioned to receive manifold 128 and permit slidable displacement therein. In certain embodiments, brush head core 132 is tapered from a larger diameter proximate the handle to a smaller diameter at the distal end. Aperture 134 is provided having a width dimension that is sufficient at least to expose outlets 130 and a length dimension that is sufficient at least to accommodate displacement distance of the manifold. In alternative embodiments, plural apertures can be provided that are each positioned in a location that is aligned with outlets 130 and are configured and dimensioned to accommodate displacement distance of the manifold.

Figure 7A:
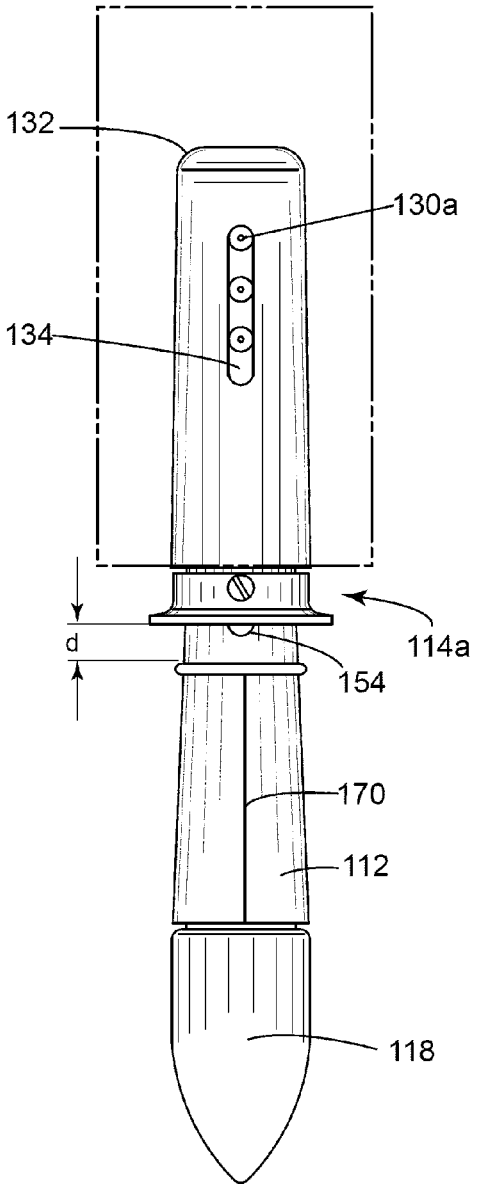
FIGS. 7A and 7B are elevation views of the spray brush of FIG. 3 showing the different trigger positions.
Figure 7B:
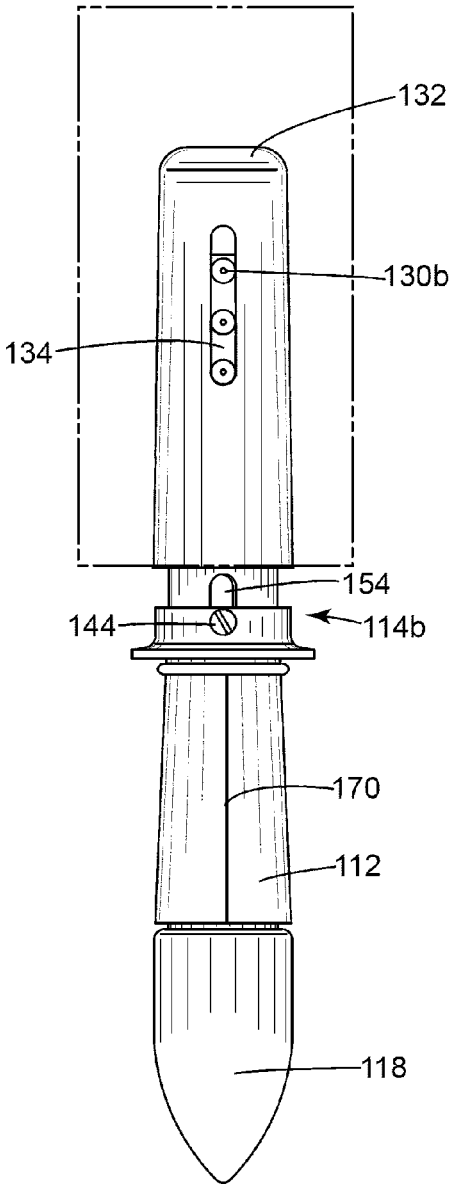

Referring to FIGS. 7A and 7B, trigger 114 is slidable between a first position (114*a* in FIG. 7A) and a second position (114*b* in FIG. 7B) relative to a portion of brush handle core 112, i.e., along a range of travel "d" shown in FIG. 7A. Trigger 114 is coupled to the manifold 128 internal to the brush head core 132. In certain embodiments as shown in FIGS. 3-8, trigger 114 is mechanically coupled to the manifold 128 by one or more fasteners 144 and trigger spacers 142 through elongated apertures 154 in the brush handle core 112 to accommodate displacement between the first position 114*a* and the second position 114*b*. The motion of trigger 114 is stopped when the fasteners 144 and trigger spacers 142 reach the lower end of aperture 154.

Various benefits are derived from the spray brush described herein. In certain embodiments, certain components including the brush head 116 are removable to facilitate cleaning (e.g., in a sink, conventional dishwasher or laundry washing machine), packing, travel, and to provide interchangeability of these parts. In additional embodiments, as shown with respect to FIGS. 3-9, reservoir 118 is removable and interchangeable with other reservoirs having a matching threaded portion 148 that mates with threaded portion 146 of handle core 112.

In certain embodiments, reservoir 118 includes a structural ridge below the threaded portion 148 to offer additional staying power and friction when the reservoir 118 is fully engaged. This prevents or minimizes the likelihood of reservoir 118 becoming unscrewed. In addition, a structural ridge relieves pressure on threaded portion 148 and enhances the durability to the reservoir 118.

In certain embodiments described herein, reservoir 118 can be exchangeable with identical reservoirs. Accordingly, a user can obtain plural reservoirs 118 and quickly exchange them, instead of refilling the reservoir each time it is emptied. In addition, a user can easily interchange between reservoirs containing different fluids. For instance, in certain embodiments, reservoirs can be color coded to identify different hair products contained therein. In certain embodiments, reservoir 118 can have a fluid capacity of about 1.8 fluid ounces to about 2.3 fluid ounces. In certain embodiments, reservoir 118 and pump assembly 122 can be provided in combination so that a user can change the mechanical pump assembly 122 when reservoir 118 is replaced. In additional embodiments, the length and/or width of reservoir 118 can be varied, with the understanding that the length of drawtube 123 may need to be and can be appropriately modified.

The spray brush described herein can be used to style or otherwise dispense fluid to human hair, animal hair or hairpieces. The types of fluids that can be used include water, conventional hair sprays, setting fluids, conditioning fluids, medicaments, or other suitable fluid.

In the embodiments shown herein, various parts and features (for instance, the wide opening at the bottom of the manifold 128) are incorporated to accommodate use of existing pump assemblies to reduce manufacturing cost. In alternative embodiments, pump assemblies of different construction can be used and thus variations of such parts and features are contemplated.

In certain embodiments, a pump assembly can be provided that is electrically activated. Accordingly, the circumferential trigger toggles an electronic switch that activates a battery operated micro-pump to transfer fluid from the reservoir to the manifold outlets. In additional embodiments, the fluid can be dispensed using force of stored gas, for instance, similar to an aerosol spray, or using a compressed gas cartridge. In the above alternative embodiments, the spray brush contains a circumferential trigger, which is mechanically coupled to a toggle to electrically or pneumatically actuate the spray, and the manifold could be fixed relative to the brush head core and the pump assembly. The circumferential trigger can easily be activated by the stylist or individual from any rotational position as described herein.

The method and system of the present invention have been described above and in the attached drawings; however, modifications will be apparent to those of ordinary skill in the art and the scope of protection for the invention is to be defined by the claims that follow.

LISTING OF NUMERALS

FIGS. 1 and 2
Spray brush 10
handle/reservoir portion 12
spray trigger 14
brush head 16
liquid reservoir 18
cap 20
manifold 28
pump assembly 22
displaceable hollow piston 25
cylinder 26
piston 25
stationary portion 24
integral ring portion 27
drawtube 23
outlets 30.
bristle base core 32
gap 34
bristle base surface 36
FIGS. 3-9
Spray brush 110
brush head 116
brush head core 132
manifold 128
outlets 130
aperture 134
fluid reservoir 118
handle core 112
trigger 114
pump assembly 122
displaceable hollow piston 125
cylinder 126
upper stationary portion 124
integral pump deck 127
drawtube 123
trigger spacers 142
fasteners 144
aperture 154
manifold fastener receptacle 145
threads 148
reservoir top portion 149
protrusion 160
protrusion or tab 162
slot 163
tapered portion 164
threads 146
pump assembly shelf 150
manifold channel 152
canals 153
alignment ridge 170
"d"—FIG. 7A—distance of trigger travel

The invention claimed is:

1. A hairbrush comprising a brush head core containing a manifold, the manifold including a plurality of fluid-dispensing outlets containing a spray nozzle extending from a channel within the manifold and arranged along an axial direction of the manifold;

a fluid reservoir;

a pump assembly; and a pump trigger in mechanical cooperation with the pump assembly, the pump trigger circumferentially surrounding a portion of a brush handle, wherein the fluid-dispensing outlets are in fluid communication with the pump assembly, the pump assembly being in fluid communication with the fluid reservoir, and wherein activation of the pump trigger is by one or more of depression or pulling from any normal hand held position without the need for additional rotation of the hairbrush.

2. The hairbrush as in claim 1, wherein the trigger is attached to the manifold by one or more fasteners through one or more corresponding elongated apertures in the brush handle to accommodate displacement between a first position and a second position.

3. The hairbrush as in claim 1 wherein the fluid reservoir is integral with the brush handle.

4. The hairbrush as in claim 1 wherein the fluid reservoir is removably attached to a portion of the brush handle.

5. The hairbrush as in claim 4, wherein the brush handle includes one or more features extending from an inner wall thereof, and wherein the pump assembly includes a stationary portion, at least a part of the stationary portion of the pump assembly is positioned interior to the brush handle between said one or more features extending from the inner wall of the brush handle and a portion of the removable fluid reservoir.

6. The hairbrush as in claim 1, wherein the brush handle includes one or more features that mate with one or more corresponding features of the brush head core to prevent rotation of the brush head core relative to the brush handle.

7. An apparatus adaptable for use with a hairbrush head comprising:

a fluid reservoir integrated in a brush handle in fluid communication with a manifold, the manifold including a fluid channel and a plurality of dispensing outlets extending from the channel and positioned and arranged along an axial direction of the manifold, and each dispensing outlet containing a spray nozzle;

a trigger slidable between a first position and a second position relative to the brush handle;

the trigger mechanically coupled to the manifold; and a pump assembly including a mechanically displaceable portion and a stationary portion, wherein the stationary portion is positioned interior to the brush handle and remains stationary during use, and wherein the mechanically displaceable portion includes a fluid passageway in fluid communication with the manifold fluid channel and is mechanically coupled to a portion of the manifold.

8. The apparatus as in claim 7, wherein the trigger is attached to the manifold by one or more fasteners through one or more elongated apertures in the brush handle to accommodate displacement between the first position and the second position.

9. The apparatus as in claim 7 wherein the fluid reservoir is integral with the brush handle.

10. The apparatus as in claim 7 wherein the fluid reservoir is removably attached to a portion of the brush handle.

11. The apparatus as in claim 10, wherein the brush handle includes one or more features extending from an inner wall thereof, and wherein at least a part of the stationary portion of the pump assembly is positioned interior to the brush handle between said one or more features extending from the inner wall of the brush handle and a portion of the removable fluid reservoir.

12. A hairbrush comprising a brush head core containing a manifold, the manifold including at least one fluid-dispensing outlet positioned on the manifold;

a fluid reservoir;

a pump assembly; and a pump trigger in mechanical cooperation with the pump assembly and circumferentially surrounding a portion of a brush handle, wherein the pump trigger is attached to the manifold by one or more fasteners through one or more corresponding elongated apertures in the brush handle to accommodate displacement between a first position and a second position;

wherein the fluid-dispensing outlets are in fluid communication with the pump assembly, the pump assembly being in fluid communication with a fluid reservoir, and wherein activation of the pump trigger is by one or more of depression or pulling from any normal hand held position without the need for additional rotation of the hairbrush.

13. The hairbrush as in claim 12 wherein the fluid reservoir is integral with the brush handle.

14. The hairbrush as in claim 12 wherein the fluid reservoir is removably attached to a portion of the brush handle.

15. The hairbrush as in claim 14, wherein the brush handle includes one or more features extending from an inner wall thereof, and wherein the pump assembly includes a stationary portion at least a part of the stationary portion of the pump assembly is positioned interior to the brush handle between said one or more features extending from the inner wall of the brush handle and a portion of the removable fluid reservoir.

16. The hairbrush as in claim 12, wherein the brush handle includes one or more features that mate with one or more corresponding features of the brush head core to prevent rotation of the brush head core relative to the brush handle.

17. A hairbrush comprising a brush head core containing a manifold, the manifold including at least one fluid-dispensing outlet positioned on the manifold;

a brush handle;

a fluid reservoir removably attached to a portion of the brush handle;

a pump assembly; and a pump trigger in mechanical cooperation with the pump assembly and circumferentially surrounding a portion of the brush handle;

wherein the brush handle includes one or more features extending from an inner wall thereof, and wherein the pump assembly includes a stationary portion, at least a part of the stationary portion of the pump assembly is positioned interior to the brush handle between said one or more features extending from the inner wall of the brush handle and a portion of the removable fluid reservoir, wherein the fluid-dispensing outlet is in fluid communication with the pump assembly, the pump assembly being in fluid communication with a fluid reservoir, and wherein activation of the pump trigger is by one or more of depression or pulling from any normal hand held position without the need for additional rotation of the hairbrush.

18. The hairbrush as in claim 17, wherein the brush handle includes one or more features that mate with one or more corresponding features of the brush head core to prevent rotation of the brush head core relative to the brush handle.

* * * * *